US007192211B2

(12) United States Patent
Heidenreiter

(10) Patent No.: US 7,192,211 B2
(45) Date of Patent: Mar. 20, 2007

(54) CONTAINER WITH ACOUSTIC BALL

(75) Inventor: Thomas Heidenreiter, Kalchreuth (DE)

(73) Assignee: Schwan-Stabilo Cosmetics GmbH & Co. KG, Heroldsberg (DE)

( * ) Notice: Subject to any disclaimer, the term of this patent is extended or adjusted under 35 U.S.C. 154(b) by 0 days.

(21) Appl. No.: 11/190,134

(22) Filed: Jul. 26, 2005

(65) Prior Publication Data

US 2006/0104703 A1 May 18, 2006

(30) Foreign Application Priority Data

Nov. 12, 2004 (DE) ..... 20 2004 017 614 U

(51) Int. Cl.
*A46B 11/00* (2006.01)

(52) U.S. Cl. ..... 401/121

(58) Field of Classification Search ..... 401/121, 401/122, 126–130

See application file for complete search history.

(56) References Cited

U.S. PATENT DOCUMENTS

| | | | | |
|---|---|---|---|---|
| 4,854,759 | A | 8/1989 | Morane et al. | |
| 5,573,340 | A | 11/1996 | Gueret | |
| 5,913,630 | A * | 6/1999 | Kelders et al. | 401/126 |
| 2005/0092343 | A1 | 5/2005 | Byun | |

FOREIGN PATENT DOCUMENTS

| | | |
|---|---|---|
| DE | 696 04 525 | 5/2000 |
| DE | 697 05 384 | 4/2002 |
| WO | WO 87/07821 | 12/1987 |
| WO | WO 2004/075682 | 9/2004 |

* cited by examiner

*Primary Examiner*—Huyen Le
(74) *Attorney, Agent, or Firm*—Bachman & LaPointe, P.C.

(57) ABSTRACT

A container (10) for substances in powder form, in particular cosmetics in powder form. The container (10) has a closure (40) with at least one closure portion (41) on which there is disposed a stem insert (50) for an applicator element (80), the stem insert being in the interior of the container in the closed condition, sufficiently accurate loading of the applicator element (80) with the substance in powder form can be advantageously guaranteed substantially independently of the filling level of the container (10). The closure (40) of the container (10) has a cavity (60; 61) containing at least one freely movable insert portion (70). By virtue of the closed container (10) being shaken, the freely movable insert portion (70) produces force pulses for removing excess substance or amounts of substance which cling loosely to the applicator element (80). Only the amount of substance necessary for an application remains on the applicator element (80). Shaking the container (10) causes a noise which represents an acoustic feedback for the user about the applicator element (80) loading operation.

14 Claims, 3 Drawing Sheets

CONTAINER WITH ACOUSTIC BALL

BACKGROUND OF THE INVENTION

The present invention concerns a container for powder substances and, more particularly, a container which comprises at least one closure portion and a stem insert with an applicator element, wherein the closure has a cavity containing at least one freely movable insert portion.

Known containers for powder cosmetics, for example for loose eyeshadow, mostly comprise a transparent plastic container which can be closed with a removable closure which—fitted into the interior of the container—carries an elongate handle portion with an applicator element. In that case the applicator element preferably comprises a soft plastic material which can be loaded with the powder to be applied. Cosmetic containers of that kind are also summarised by the name dip systems.

A disadvantage in the case of known application devices of the kind outlined in the opening part of this specification is that the loading of the applicator element is not uniform, in particular in dependence on the amount of filling material which is still contained in the cosmetic container. The operation of loading the applicator element is effected by dipping into the powder cosmetic contained in the container. In that case adhesion to the applicator element is inter alia dependent on the level to which the container is filled with the powder substance, for example a powder. With increasing emptying of the container, compacting of the powder on the applicator surface is reduced. Because of that, but also in general terms, there is the possibility that too much of the cosmetics to be applied remains on the applicator element and then drops off it after it has been withdrawn from the cosmetic container. The consequence of that can be soiling of clothing. At the least however the outcome of the makeup procedure is endangered or ruined by such cosmetic material which is inaccurately quantitatively controlled and in particular is applied in excess. It is quite particularly unpleasant and therefore disadvantageous from the point of a user if excess material, for example when applying eyeshadow, transfers from the eyelid into the conjunctiva sac of the eye because there it can give rise to irritation. As soon as the content of the cosmetic container is substantially used up, the applicator element is only inadequately loaded with the powder cosmetic to be applied. Then also the outcome of applying the makeup is only still moderate and is unsatisfactory from the point of view of the user.

Therefore an object of the invention is to provide a container with which an applicator element—substantially independently of the amount of filling content in the container—is uniformly loaded but overloading is also avoided.

SUMMARY OF THE INVENTION

The object according to the invention is attained by a container substances in powder form having a closure which comprises at least a closure portion and a stem insert. Mounted to the stem insert is an applicator element which is disposed in the interior of the container in the closed condition of the container. The closure of the container has a cavity which contains at least one freely movable insert portion. The container is particularly suitable for cosmetic substances in powder form such as for example a makeup powder or a loose eyeshadow.

By shaking the closed container, that is to say when the closure is fitted thereto and the applicator element is in the inside thereof, the freely movable insert portion causes force pulses or force shocks to be applied to the wall of the cavity, and they are transmitted to the applicator element. The insert portion thus performs the function of an impact body, wherein the strength of the force pulses can be determined by the parameters of the geometry and the material density of the insert portion and the fall height, that is to say the free travel length in the cavity for the insert portion when the container is shaken. Excess cosmetic material which is clinging to the applicator element is knocked off by the pulses produced in the container according to the invention. As a consequence, an amount required for successful application thus remains on the applicator element. That loading or application amount can be substantially determined by the size of the surface area and the surface nature of the applicator element and is controllable in that way.

The success of using a dip system according to the invention as a cosmetic container with integrated applicator is basically improved by the invention. In addition, the noise which is produced when the cosmetic container is shaken represents a particularly advantageous acoustic feedback in terms of optimising the loading of the applicator element, that is to say the applicator element loading procedure. On the one hand, the shaking pulses or force shocks exerted on the applicator element by the insert portion prevent the applicator element from being overloaded, but on the other hand shaking the arrangement also ensures that the applicator element is sufficiently loaded when the cosmetic container is already relatively greatly emptied. In that way removal of the remaining powder substance from the cosmetic container is also markedly facilitated or promoted by the container according to the invention.

In the case of the container according to the invention it has been found to be particularly advantageous if the insert portion is not disposed together with the powder substance in the container but is disposed separately therefrom in a cavity provided specifically for same. That permits a sufficient freedom of movement for the insert portion and thus affords the effective transmission of force pulses to the applicator element by way of the holder thereof.

In a first embodiment of the container according to the invention the cavity for the insert portion is disposed in the closure portion. The closure portion which is hollow in its interior can be easily produced in the form of a plastic portion from a thermoplastic material using an injection molding process or a blow molding process. It is however also possible for the closure portion to be produced from a thermosetting material using a pressing process. The appropriately dimensioned insert portion which is freely movable in the closure portion is introduced into the cavity of the closure portion in the production procedure, to attain the object of the invention. The cavity, that is to say the open end of the closure portion, can be particularly easily closed by the stem insert and the insert portion can no longer fall out.

In an alternative embodiment of the container according to the invention the cavity for the insert portion is integrated directly in the stem insert. The stem insert can be produced similarly to the closure portion, in which case provided in an end of the stem insert, which is in opposite relationship to the applicator element, is an opening through which the suitably dimensioned insert portion can be introduced into the cavity of the stem insert in the manufacturing procedure. The cavity can then be closed by joining the stem insert to the closure portion just as easily as in the first embodiment.

Preferably the applicator element mounted to the stem insert, in the closed condition of the container, is at a spacing from the plane defined by the opening of the container, of between one-third of the height of the container to just before the bottom of the container. In other words, in the closed condition of the container, the applicator element mounted to the stem insert extends, measured from the plane defined by the opening of the container, between about one-third of the height of the container to just short of the bottom of the container. Positioning of the applicator element in the interior of the container in that way has proven to be particularly suitable for ensuring that the applicator element is loaded with the substance in powder form, uniformly over all filling levels of the container.

The height of the closure portion can be a multiple of the height of the container. That is desired in particular if the applicator element mounted to the stem insert is to be particularly easy to handle. A closure portion of an elongate configuration then performs a similar function to the handle stem of a brush.

Any closure which ensures that the container is sealingly closed and which in particular does not unintentionally come open when the container is shaken as is required by the invention is suitable as the closure mechanism for the container. A screw closure is therefore particularly preferred. If a particularly compact structural configuration for the container is wanted, then the height of the closure portion can also be restricted essentially to the height of the screwthread of the screw closure. Such an embodiment is particularly suitable as a development of the alternative embodiment as there the insert portion is contained in the stem insert and therefore the shaking cavity in the closure portion is not required.

In regard to the insert portion it is to be noted that it is of such a dimension that it does not tend to become jammed upon shaking in the cavity which can also be of a tapering cross-section in the form of a portion of a cone or some other irregular shape. Suitable materials for the insert portion are those which are sufficiently hard to be able to apply a force pulse to the inserted stem portion when the container is shaken. Particularly preferred materials are those which additionally produce a noise as acoustic feedback upon being shaken. At the same time the insert portion should not be too heavy so that, when the screw closure is tilted during handling, it does not produce any significant pulse which causes an unwanted counter-reaction on the part of the user, which could result in spilling the material to be applied.

In principle therefore small pieces of metal, ceramic, glass or a combination thereof are suitable as the insert portion as then there is no risk of it becoming jammed. If however such a material is of a relatively high specific weight such as for example in the case of metal, there can be the danger that such a metal body impacts against the inside wall excessively hard and damages it or even knocks a hole through it, in the event of repeated and excessively vigorous shaking. For that reason insert portions comprising a suitable hard plastic material are preferably used. They can comprise for example polyester, polyamide, polypropylene, polynitrile, polyacrylate, ebonite, hard rubber or also phenoplastic resins, aminoplastic resins, epoxy resins, urea formaldehyde condensates and the like. In particular the choice of the material for the one or more insert portions can also be such that when the insert portion knocks together with the wall of the cavity or a plurality of insert portions knock against each other that produces a pleasant noise. The insert portion then affords the function of an 'acoustic ball' which can prompt the user to repeat the shaking procedure before each use.

In principle the insert portion can be of any desired shape which permits free mobility in the cavity provided for the insert portion. Thus the insert portion can be in the form either of a ball, a cylinder, a tube portion, a cube, a cuboid or a shear portion—an irregularly shaped portion which serves for the production of balls—. It is also possible to use a plurality of uniform or differently shaped insert portions.

BRIEF DESCRIPTION OF THE DRAWINGS

Further advantages of the invention are described in conjunction with the description of an embodiment by way of example of the present invention together with the Figures in the drawing. The terms used in this respect 'left', 'right', 'bottom' and 'top' relate to the Figures with the Figure identifications being readable normally. It is further to be pointed out that the same components are denoted by the same references in the individual Figures. In the drawing.

DETAILED DESCRIPTION

Figure 1:
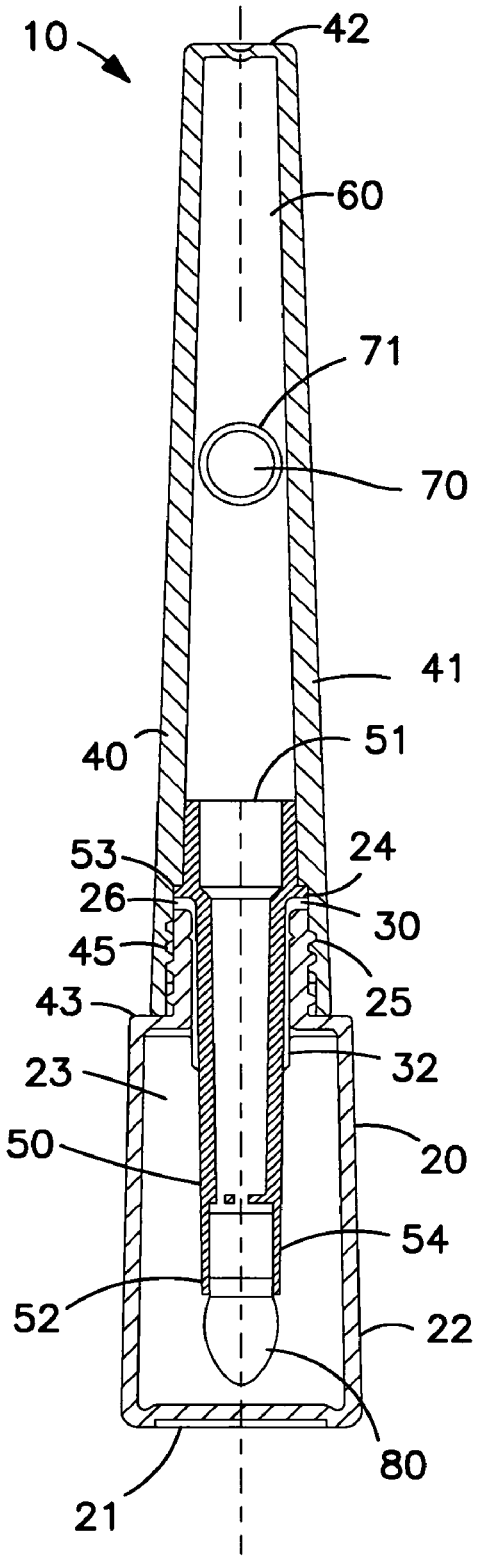
FIG. 1 shows a cross-sectional view of a first embodiment of the container according to the present invention.

FIG. 1 shows a cross-sectional view of a first embodiment of the container according to the present invention. The container 10 comprises a container body 20 and a closure 40. The container body 20 has a substantially flat container body 21 which makes it possible for the container 10 according to the invention to be securely placed upright on flat surfaces. The container body 20 also has a substantially uniformly thick container body wall 22 and a container interior 23 which is provided for accommodating a substance in powder form. Disposed at the side of the container body 20, that is opposite to the container bottom 21, is a container opening 24 which projects beyond the container body 20 in a bottle neck-like configuration and which has a corresponding male screwthread 25 for closure with a screwthread closure. It should be noted that basically the container body 20 can be of any desired shape, in which respect it is self-evident that, in the case of a screw closure, the closable container opening 24 is of a circular cross-section. A scraper 30 is fitted into the container opening 24 which is of a bottle neck-like configuration in the illustrated embodiment. The scraper 30 preferably comprises a soft elastic material. The function of the scraper 30 is described in greater detail hereinafter.

The container 10 according to the invention as shown in FIG. 1 is closed by a closure 40 which substantially comprises a closure portion 41 and a stem insert 50 connected to the closure portion 41. In the construction of the first embodiment by way of example of the container according to the invention, the closure portion 41 is in the form of an elongate handle portion, similarly to the handle stem of a brush. Disposed in the closure portion 41 is a cavity 60 in the shape of a cone, wherein the conical cavity 60 tapers towards the closed end 42 of the closure portion and has an opening at the open end 43 of the closure portion 41. An insert portion 70 according to the invention which is freely movable is inserted in the cavity 60 in order to provide the function of the impact body according to the invention. It will be appreciated that the internal shape of the cavity 60 can also be of any other suitable geometry.

In the embodiment illustrated in FIG. 1 the insert portion 70 is in the form of a ball 71. It should be noted that the insert portion 70 can also be of any other suitable geometrical shape such as for example that of a cylinder, a tube portion, a cube, a cuboid or a shear portion. Disposed at the open end 43 of the closure portion 41, which is towards the container body 20 in the closed condition of the container 10, is a female screwthread 45 which matches the male screwthread 25 of the container opening 24. In manufacture of the container 10 according to the invention, after the insert portion 70 has been introduced into the closure portion 41, the cavity 60 in the closure portion 41 is closed by inserting the stem insert 50. In that way insertion of the insert portion 70 according to the invention can be integrated into the procedure for manufacture of the container 10 according to the invention, without additional expenditure and complication. In that case the insert portion 70 is integrated into the container 10 according to the invention, in a condition of being disposed in 'its' cavity 60 separately from the substance in powder form. The stem insert 50 is shaped in such a way that it can be connected to the closure portion 41 in positively locking relationship with a first end 51 which is inserted into the closure portion 41. It should be noted that it is possible to use any connecting process which is suitable for connecting the materials constituting the stem insert 50 and the closure portion 41, in order to permanently connect the two parts together. It should however also be pointed out that a connection in respect of the materials involved is not absolutely required, on the basis of the configuration of the closure portion 41 and the stem insert 50. Rather, it may be sufficient for the stem insert 50 to be pressed into the closure portion 41. Therefore the illustrated configuration of the stem insert 50 is particularly advantageous, with a shoulder 53 at the end 51 which is inserted into the closure portion 41, the shoulder 53 performing the function of an abutment both in the direction of the closure portion 41 when the parts are assembled, but also affording an abutment which co-operates with the edge 26 of the container opening 24 when the container 10 is closed. That ensures on the one hand that the stem insert 50 is inserted to a predetermined depth of insertion in production of the container 10 but also provides that shaking, in accordance with the invention, the closed container 10 and thus the action of the force shocks of the insert portion 70 on the stem insert 50 cannot result in the stem insert 50 coming loose from the closure portion 41.

Disposed at the second end 52 of the stem insert 50, which is in opposite relationship to the closure portion 41, is an applicator receiving means 54 in which an applicator element 80 is fixed. It should be noted that, as shown in FIG. 1, the stem insert 50 is itself hollow in its interior and thus the entire cavity in which the insert portion according to the invention can be accelerated upon being shaken in a freely movable manner to produce force pulses extends from the second end 52 of the applicator receiving means 54 of the stem insert 50 as far as the closed end 42 of the closure portion 41. It is also possible for the stem insert 50 to be closed at its end which is inserted into the closure portion 41 so that the cavity 60 in the closure portion 41 is defined essentially only by the space extending from the stem insert 50 to the end of the closure portion 41.

It is possible to clearly see a scraper edge 32 of the scraper 30, the scraper edge being provided to ensure that substance residues in powder form which are on the stem insert 50 are scraped of f the stem insert 50 when the stem insert 50 is withdrawn from the container body 20.

Figure 2:
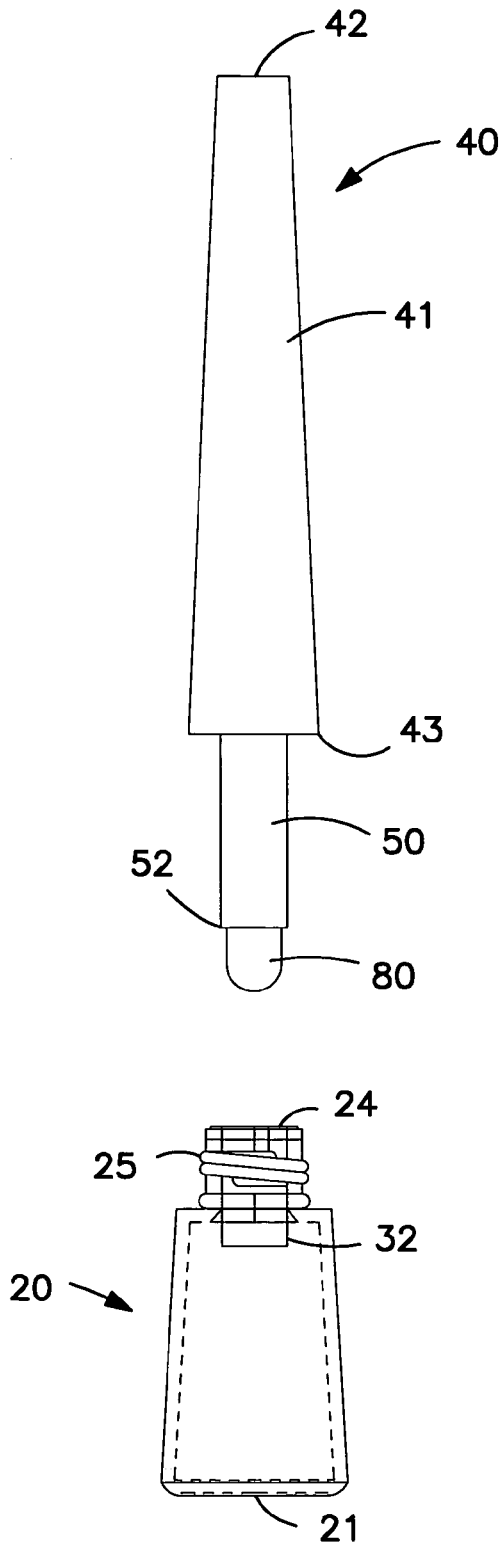
FIG. 2 shows a side view of the first embodiment in the open condition with the container body and the closure.

FIG. 2 shows a side view of the container according to the invention as illustrated in FIG. 1 in the open condition, that is to say the closure 40 which comprises a closure portion 41 forming a handle and a stem insert 50 which is inserted therein with the applicator element 80 has been withdrawn from the container 10. The male screwthread 25 forming part of the closure 40 is clearly shown on the container body 20.

It is possible to clearly see here the scraper 30 and the scraper edge 32 of the scraper 30, by which powder substance residues on the stem insert 50 are scraped off the stem insert 50 when the stem insert 50 is withdrawn from the container body 2. That has the advantage that on the one hand application of the substance in powder form with the applicator element 80 cannot be adversely affected by substance residues on the stem insert 50 itself, but also that excess substance residues of that kind remain in the container interior 23 by virtue of being scraped off at the scraper edge 32, and are therefore not wasted. The closure portion 41 of a handle-like configuration can be clearly seen in FIG. 2 on the closure 40 and likewise the stem insert 50 which projects from the closure portion 41 and on which the applicator element 80 is carried at the end facing in the direction of the container 10.

Figure 3:
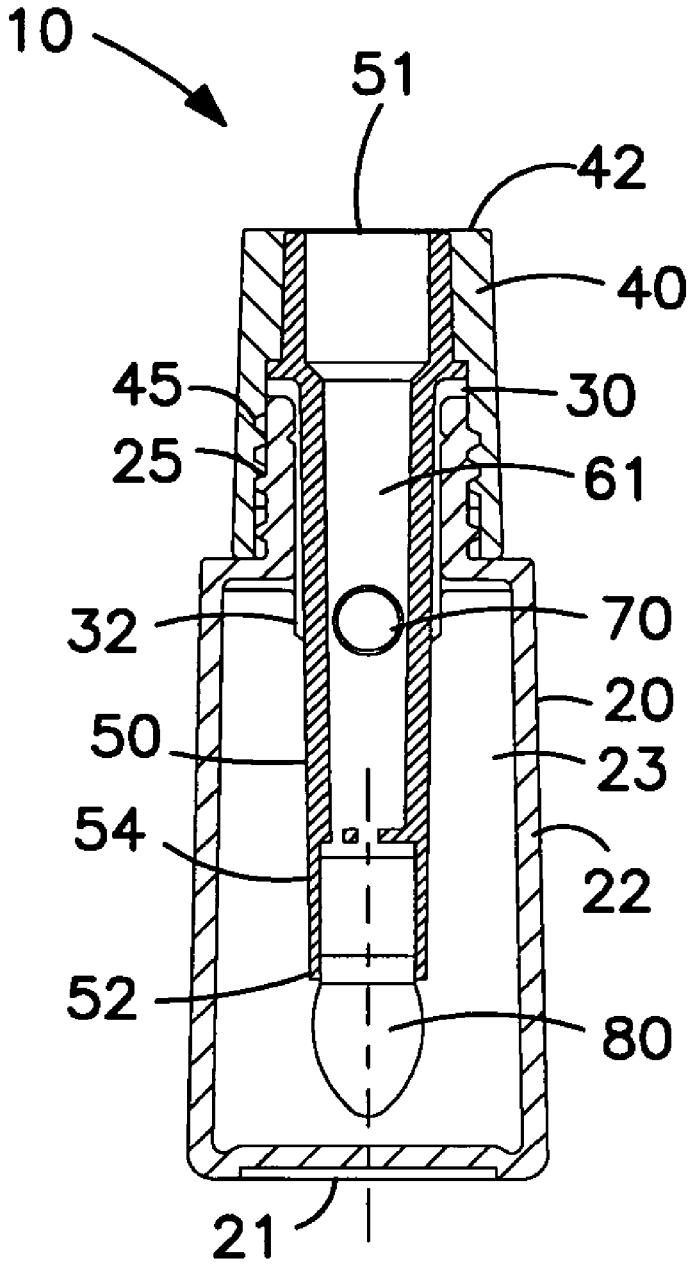
FIG. 3 shows a cross-sectional view of an alternative embodiment of the container according to the invention.

FIG. 3 shows an alternative embodiment of the container 10 according to the invention. For the avoidance of repetition, reference will be made hereinafter only to differences between the first embodiment and this alternative embodiment. The essential difference is that the insert portion 70 according to the invention is disposed in a cavity 61 in the stem insert 50. The function of the embodiment shown in FIG. 3 is identical to that of the embodiment shown in FIGS. 1 and 2. The FIG. 3 embodiment of the container 10 according to the invention is appropriate in particular when an especially compact configuration, that is to say in particular a structural height which is as small as possible, is wanted for the container.

The present invention provided a container for substances in powder form, which has a closure with at least one closure portion on which there is disposed a stem insert for an applicator element, the stem insert being in the interior of the container in the closed condition. Sufficiently accurate loading of the applicator element with the substance in powder form can be guaranteed by means of that container, substantially independently of the filling level of the container. For that purpose the closure of the container has a cavity containing at least one freely movable insert portion. By virtue of the closed container being shaken, the freely movable insert portion produces force pulses for removing excess substance or amounts of substance which cling loosely to the applicator element. As a result only the amount of substance necessary for an application remains on the applicator element. It is also particularly advantageous that shaking the container causes a noise which represents an acoustic feedback for the user about the applicator element loading operation.

It should be noted that use of the container according to the invention is not restricted to cosmetic products. Such a container can in principle be used in all areas in which a substance in powder form is to be applied by means of an applicator element to a surface and sufficiently accurately loading of the applicator element with the substance in powder form is to be guaranteed, substantially independently of the filling level of the container.

The invention claimed is:

1. A container for substances in powder form comprising a closure which comprises at least a closure portion and a stem insert with an applicator element which, in the closed condition, is in the interior of the container, wherein the closure has a cavity containing at least one freely movable insert portion, wherein the cavity and the at least one freely movable insert portion are isolated from the powder in the interior of the container.

2. A container as set forth in claim 1, wherein the cavity is in the closure portion.

3. A container as set forth in claim 2, wherein the cavity is closed by the stem insert.

4. A container as set forth in claim 1, wherein the cavity is in the stem insert.

5. A container as set forth in claim 1, wherein, when in the closed condition, the applicator element carried on the stem insert is at a spacing from the plane defined by the opening of the container of between one-third of the height of the container to shortly before the container bottom of the container.

6. A container as set forth in claim 1, wherein the height of the closure portion has a height which is a multiple of the height of the container.

7. A container as set forth in claim 1, wherein the closure is a screw closure.

8. A container as set forth in claim 7, wherein the closure portion has a height which is substantially the height of the screwthread of the screw closure.

9. A container as set forth in claim 1, wherein the at least one insert portion is selected from the group consisting of a ball, a cylinder, a tube portion, a cube, a cuboid and a shear portion.

10. A container as set forth in claim 1, wherein the at least one insert portion comprises a material selected from the group consisting of metal, ceramic, glass and mixtures thereof.

11. A container as set forth in claim 1, wherein the at least one insert portion comprises a plastic material.

12. A container as set forth in claim 11, wherein the plastic material is selected from the group consisting of polyester, polyamide, polypropylene, polynitrile, polyacrylate, ebonite, hard rubber and mixtures thereof.

13. A container as set forth in claim 11, wherein the at least one insert portion is selected from the group consisting of phenoplastic resin, aminoplastic resin, epoxy resin, and a urea formaldehyde condensate.

14. A container as set forth in claim 1, wherein the substance in powder form is a cosmetic substance.

* * * * *